US005888632A

United States Patent [19]

Yamanaka et al.

[11] Patent Number: 5,888,632

[45] Date of Patent: Mar. 30, 1999

[54] HEAT-SENSITIVE TRANSFER RECORDING MEDIUM AND METHOD OF USING THE SAME

[75] Inventors: Tomoaki Yamanaka; Toshiyuki Yamane, both of Osaka, Japan

[73] Assignee: Fujicopian Co., Ltd., Osaka, Japan

[21] Appl. No.: 786,242

[22] Filed: Jan. 21, 1997

[30] Foreign Application Priority Data

Jan. 22, 1996 [JP] Japan ..... 8-008588

[51] Int. Cl.[6] ..... B41M 5/26

[52] U.S. Cl. ..... 428/212; 428/195; 428/413; 428/480; 428/913; 428/914

[58] Field of Search ..... 428/195, 484, 428/488.1, 488.4, 413, 480, 212

[56] References Cited

U.S. PATENT DOCUMENTS 4,777,079 10/1988 Nagamoto et al. ..... 428/488.4
5,269,856 12/1993 Kushida et al. ..... 428/488.4

*Primary Examiner*—Pamela R. Schwartz
*Attorney, Agent, or Firm*—Fish & Neave

[57] ABSTRACT

A heat-sensitive transfer recording medium is disclosed which comprises a support having thereon a first ink layer and a second ink layer provided on the first ink layer, the first ink layer comprising a coloring agent and an epoxy resin, the second ink layer comprising a coloring agent and a polyester resin. The heat-sensitive transfer recording medium is advantageously used to form a printed image excellent in both scratch resistance and alcohol resistance on an image receptor comprising a polyester film or an image receptor comprising a substrate having thereon an image-receiving layer comprising a polyester resin.

7 Claims, No Drawings

HEAT-SENSITIVE TRANSFER RECORDING MEDIUM AND METHOD OF USING THE SAME

BACKGROUND OF THE INVENTION

The present invention relates to a heat-sensitive transfer recording medium useful for forming printed images on an image receptor comprising a polyester film or the like, by a thermal transfer method, and to a method for forming printed images using the same.

Heretofore, with a label printer or like printer utilizing thermal transfer technology, a heat-sensitive transfer recording medium is used to form printed images on a plastic film such as polyester film. The label printer is called various names such as tape printer. Herein, however, the name "label printer" is used.

Printed images formed on labels and the like are required to have excellent fastness such as scratch resistance and chemical resistance including alcohol resistance.

For this reason, heat-sensitive transfer recording media have used a colored ink layer containing one or more resins excellent in scratch resistance or alcohol resistance as a binder thereof.

With the conventional heat-sensitive transfer media having such a colored ink layer of single layer, however, it is difficult to obtain printed images excellent in both scratch resistance and alcohol resistance even though a resin having good scratch resistance and a resin having good alcohol resistance are used in combination. This is because the resin having good scratch resistance is not necessarily good in alcohol resistance and the resin having good alcohol resistance is not necessarily good in scratch resistance.

In order to solve this problem, a type of heat-sensitive transfer recording medium comprising a support, a transparent barrier layer provided on the support and composed of a polyester resin, an epoxy resin or the like, and a colored ink layer provided on the barrier layer and composed of a polyester resin or the like as a binder thereof (hereinafter referred to as "prior art A", see Japanese Unexamined Patent Publication Nos. 2-150391 and 2-160589) has been proposed. Another type of heat-sensitive transfer recording medium comprising a support, a colored ink layer provided on the support, and an adhesive layer provided on the colored ink layer and composed of a polyester resin or the like (hereinafter referred to as "prior art B", see Japanese Unexamined Patent Publication No. 4-27589) has also been proposed.

However, prior art A involves a problem of causing a tailing of the printed image due to poor separability of the barrier layer when being thermally transferred. Herein, the term "separability" of a transfer layer means the property that when being transferred, the heated portion of a transfer layer is easily separated from the unheated portion of the transfer layer and only the heated portion is transferred onto an image receptor to give a printed image with good definition. The term "tailing of the printed image" means the phenomenon that ink in an unheated portion in the neighborhood of the heated portion is transferred on the downstream side of predetermined ink dots to thicken lines constituting an image. Further, when the binder of the colored ink layer is different from that of the barrier layer, there also arises a problem that the colored ink layer is separated at the interface between the colored ink layer and the barrier layer and transferred. As a result the barrier layer is not present on the colored ink layer in the resulting the expected scratch resistance is not achieved.

Prior art B also involves the problem of causing a tailing of the printed image due to poor separability of the adhesive layer. Prior art B involves another problem that the colored ink layer, having small thickness in the resulting image, is exposed, resulting in poor scratch resistance.

In view of the foregoing, it is an object of the present invention to provide a heat-sensitive transfer recording medium capable of forming printed images of both excellent scratch resistance and excellent alcohol resistance by allowing respective resin binders used in the ink layer to fully exhibit their own functions.

This and other objects of the present invention will become apparent from the description hereinafter.

SUMMARY OF THE INVENTION

According to a first aspect of the present invention, there is provided a heat-sensitive transfer recording medium for use in forming a printed image on an image receptor by a thermal transfer method, comprising a support having thereon a first ink layer and a second ink layer provided on the first ink layer, the first ink layer comprising a coloring agent and an epoxy resin, the second ink layer comprising a coloring agent and a polyester resin.

According to a second aspect of the present invention, there is provided a method for forming a printed image on an image receptor comprising the steps of:

providing a heat-sensitive transfer recording medium comprising a support having thereon a first ink layer and a second ink layer provided on the first ink layer, the first ink layer comprising a coloring agent and an epoxy resin, the second ink layer comprising a coloring agent and a polyester resin, selectively heat-transferring the first ink layer and the second ink layer together to form a printed image on an image receptor comprising a polyester film or an image receptor comprising a substrate having thereon an image-receiving layer comprising a polyester resin.

DETAILED DESCRIPTION

The heat-sensitive transfer recording medium of the present invention is characterized in that a heat-sensitive colored ink layer to be provided on a support is divided into a first ink layer disposed on the support side and a second ink layer diposed on the first ink layer. The first ink layer is composed of a coloring agent and an epoxy resin of excellent scratch resistance and the second ink layer is composed of a coloring agent and a polyester resin of excellent alcohol resistance.

The reason why the epoxy resin is used in the first ink layer is as follows: With the resulting image formed by a thermal transfer method, the first ink layer containing an epoxy resin of excellent scratch resistance is present on the top of the image, so that the image is excellent in scratch resistance. Even if the first ink layer is damaged with an alcohol, the underlying second ink layer containing a polyester resin of excellent alcohol resistance remains, thereby ensuring a desired reflection optical density.

The reason why the polyester resin is used in the second ink layer is as follows: The fixability of a printed image to an image receptor comprising a polyester film or an image receptor comprising a substrate having thereon an image-receiving layer composed of a polyester resin is enhanced, thereby improving scratch resistance of the image.

Further, the first ink layer and the second ink layer both contain a coloring agent to improve the separability of the respective ink layers, so that the tailing phenomenon encountered with prior arts A and B does not occur. Additionally, the problem of the second ink layer is separating from the first ink layer when being thermally transferred is eliminated.

The present invention will now be described in detail.

In the present invention, the first ink layer or second ink layer is intended to be an ink layer which is meltable or capable of being softened during thermal transfer.

The first ink layer is composed of a coloring agent and an epoxy resin. The first ink layer containing an epoxy resin as a binder exhibits an excellent separability when being thermally transferred and the use of the first ink layer provides a printed image exhibiting excellent scratch resistance.

Useful as the epoxy resin for the first ink layer are various epoxy resins. However, preferred examples are tetraphenolethane tetraglycidyl ether, cresol novolak polyglycidyl ether, bisphenol A diglycidyl ether and bisphenol F diglycidyl ether. These epoxy resins can be used either singly or in combination of two or more species thereof. The use of such specific epoxy resins further improves the separability of the first ink layer and provides a printed image with improved scratch resistance.

Tetraphenolethane tetraglycidyl ether (hereinafter referred to as "TPETGE" as the need arises) as aforementioned is a species of polyfunctional epoxy resins and is represented by formula (I):

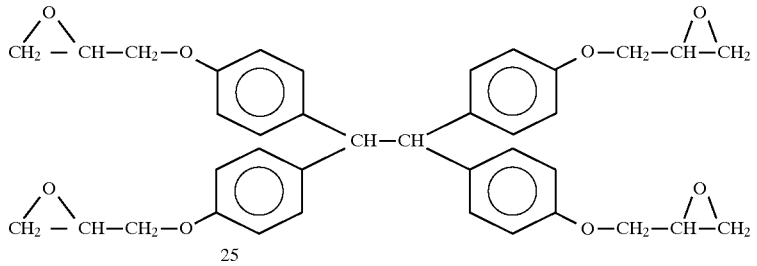

(I)

TPETGE has a softening point of about 92° C.

Cresol novolak polyglycidyl ether (hereinafter referred to as "CNPGE" as the need arises) as aforementioned is a species of polyfunctional epoxy resins. In the present invention preferred examples of CNPGEs include those represented by formula (II):

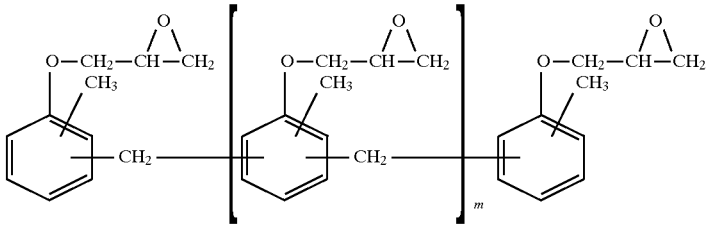

(II)

wherein m is usually an integer of from 3 to 7. CNPGEs useful in the present invention include mixtures of those of formula (II) wherein values for m are different from each other. CNPGE preferably has a softening point of 60° to 120° C.

Bisphenol A diglycidyl ether (hereinafter referred to as "BPADGE" as the need arises) is a species of difunctional epoxy resins. Preferred are those represented by formula (III):

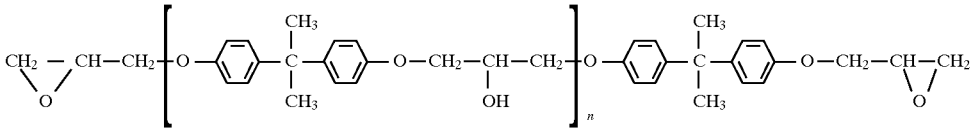

(III)

wherein n is usually an integer of from 0 to 13. BPADGEs useful in the present invention include mixtures of those of formula (III) wherein values for n are different from each other. BPADGE preferably has a softening point of 60° to 140° C.

Bisphenol F diglycidyl ether (hereinafter referred to as "BPFDGE" as the need arises) is a species of difunctional epoxy resins. Preferred are those represented by formula (IV):

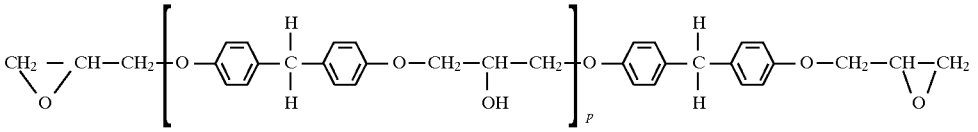

(IV)

wherein p is usually an integer of from 0 to 33. BPFDGEs useful in the present invention include mixtures of those of formula (IV) wherein values for p are different from each other. BPFDGE preferably has a softening point of 60° to 140° C.

In the present invention it is particularly desirable that the epoxy resin component is entirely composed of at least one of the above-specified epoxy resins. It is, however, not necessarily required to do so, and an epoxy resin component containing not less than 50% (% by weight, hereinafter the same), preferably not less than 70% of at least one of the four specified epoxy resins can exhibit the desired effect with respect to separability, scratch resistance, and the like. If the proportion of such specified epoxy resin in the overall epoxy resin component is less than the foregoing range, the dispersibility of a pigment in the binder is decreased, so that the separability of the first ink layer is not sufficiently improved.

The epoxy resin component may contain an epoxy resin other than the above-specified epoxy resins.

Examples of epoxy resins useful in combination with the aforementioned specified epoxy resins are:

(1) Glycidyl ether type epoxy resins including, for example, brominated bisphenol A diglycidyl ether, brominated bisphenol F diglycidyl ether, hydrogenated bisphenol A diglycidyl ether, glycerol triglycidyl ether, pentaerythritol diglycidyl ether and naphthol-modified cresol novolak polyglycidyl ether;

(2) Glycidyl ether ester type epoxy resins including, for example, p-oxybenzoic acid glycidyl ether ester;

(3) Glycidyl ester type epoxy resins including, for example, phthalic acid diglycidyl ester, tetrahydrophthalic acid diglycidyl ester, hexahydrophthalic acid diglycidyl ester and dimer acid diglycidyl ester;

(4) Glycidyl amine type epoxy resins including, for example, glycidylaniline, triglycidyl isocyanurate and tetraglycidylaminodiphenylmethane;

(5) Linear aliphatic epoxy type epoxy resins including, for example, epoxidized polybutadiene and epoxidized soybean oil; and (6) Alicyclic epoxy type epoxy resins including, for example, 3,4-epoxy-6-methylcyclohexylmethyl 3,4-epoxy-6-methylcyclohexanecarboxylate and 3,4-epoxycyclohexylmethyl 3,4-epoxycyclohexanecarboxylate.

When these other epoxy resins are used, they can be used either alone or as mixtures of two or more species thereof. Preferable as epoxy resins useful in combination with the specified epoxy resins are those having softening points of not lower than 60° C. However, an epoxy resin in a liquid state can also be used so long as the overall binder material resulting from mixing it with the specified epoxy resin or the epoxy resin useful in combination therewith has a softening point of not lower than 60° C.

The foregoing binder may be incorporated with one or more thermoplastic resins other than the epoxy resin component so long as the purpose of the present invention is attained. Examples of such thermoplastic resins include ethylene-vinyl acetate copolymer resin, ethylene-alkyl (meth)acrylate copolymer resin, phenolic resin, copolymer resin of styrene and acrylic monomer, polyester resin and polyamide resin.

The content of the epoxy resin component (preferably the aforesaid specific epoxy resin) in the first ink layer is preferably from 20 to 80%, more preferably from 30 to 70%. When the content of the epoxy resin component is lower than the above range, the resulting printed image does not exhibit satisfactory scratch resistance. When the content of the epoxy resin component is higher than the above range, the separability of the first ink layer is degraded and the optical density of the image is unsatisfactory due to the relatively low content of the coloring agent.

Useful as the coloring agent in the first ink layer are carbon black and other various organic and inorganic pigments and fluorescent pigments. Examples of such organic and inorganic pigments include azo pigments (such as insoluble azo pigments, azo lake pigments and condensed azo pigments), phthalocyanine pigments, nitro pigments, nitroso pigments, anthraquinonoid pigments, nigrosine pigments, quinacridone pigments, perylene pigments, isoindolinone pigments, dioxazine pigments, titanium white, calcium carbonate and barium sulfate. Such pigments may be used in combination with dyes for adjusting the color of the ink layer. The content of the coloring agent in the first ink layer is preferably from 20 to 80%, more preferably from 30 to 70%.

The first ink layer can be incorporated with a dispersing agent, a body pigment, etc. in addition to the foregoing components.

A coating liquid for the first ink layer can be prepared by dissolving or dispersing the epoxy resin in a suitable solvent (including water) and then dissolving or dispersing the coloring agent and optionally other additives. The coating liquid is applied onto a support and dried to give a first ink layer.

The coating amount (on a dry weight basis, hereinafter the same) of the first ink layer is preferably from 0.3 to 2.0 g/m$^2$.

The second ink layer is composed of a coloring agent and a polyester resin. The second ink layer using a polyester resin as a binder resin is excellent in alcohol resistance and exerts a strong adhesion to an image receptor, the receptor being a polyester film or having an image-receiving layer composed of a polyester resin.

The polyester resin is preferably a linear saturated polyester resin prepared by polycondensation of one or more acid components and one or more diol components. Examples of the acid components are saturated dicarboxylic acids such as phthalic acid, phthalic anhydride, sebacic acid and azelaic acid, and dimer acids. Examples of the diol components are ethylene glycol, propylene glycol, decanediol, dedecanediol hexadecanediol, bisphenol compounds and addition products of bisphenol compounds with ethylene oxide and/or propylene oxide.

The polyester resin useful in the present invention preferably has a hydroxyl value of not greater than 10 (mg KOH/g. hereinafter the same) and a glass transition point of not lower than 60° C. A polyester resin having a hydroxyl value of not greater than 10 has improved alcohol resistance. A polyester resin having a glass transition point of not lower than 60° C. is excellent in heat resistance and the use of the polyester resin provides a printed image which is not ruined at high temperatures.

The content of the polyester resin in the second ink layer is preferably from 30 to 80%, more preferably from 40 to 70%. When the content of the polyester resin is lower than the above range, the resulting printed image is poor in alcohol resistance. When the content of the polyester resin is higher than the above range, the separability of the second ink layer is degraded and the optical density of the image is unsatisfactory due to the relatively low content of the coloring agent.

The second ink layer may be incorporated with one or more thermoplastic resins other than the polyester resin so long as the purpose of the present invention is attained. Examples of such thermoplastic resins include ethylene-vinyl acetate copolymer resin, ethylene-alkyl (meth)acrylate copolymer resin, phenolic resin, copolymer resin of styrene and acrylic monomer and polyamide.

Useful as the coloring agent in the second ink layer are the same pigments as listed for possible use in the first ink layer. The pigments may be used in combination with dyes for adjusting the color of the ink layer. The content of the coloring agent in the second ink layer is preferably from 20 to 70%, more preferably from 30 to 60%.

The second ink layer can be incorporated with a dispersing agent, a body pigment, etc. in addition to the foregoing components.

A coating liquid for the second ink layer can be prepared by dissolving or dispersing the polyester resin in a suitable solvent (including water) and then dissolving or dispersing a coloring agent and optionally other additives. The coating liquid is applied onto the first ink layer and dried to give a second ink layer.

The coating amount of the second ink layer is preferably from 0.5 to 3.0 g/m$^2$.

In the present invention, a release layer may be provided between the support and the first ink layer as required. The release layer is composed of a wax as a main ingredient and incorporated with a thermoplastic resin as required.

Examples of specific waxes include: natural waxes such as haze wax, bees wax, lanolin, carnauba wax, candelilla wax, montan wax and ceresine wax; petroleum waxes such as paraffin wax and microcrystalline wax; synthetic waxes such as oxidized waxes, ester waxes, polyethylene wax, Fischer-Tropsch wax and α-olefin-maleic anhydride copolymer wax; higher fatty acids such as lauric acid, myristic acid, palmitic acid, stearic acid and behenic acid; higher aliphatic alcohols such as stearyl alcohol and docosanol; esters such as higher fatty acid monoglycerides, sucrose fatty acid esters and sorbitan fatty acid esters; and amides and bisamides such as oleic acid amide. These waxes may be used either alone or in combination.

Examples of specific thermoplastic resins (including elastomers) include polyester resins, polyamide resins, polyurethane resins, ethylene-vinyl acetate copolymer, vinyl chloride-vinyl acetate copolymer, vinyl chloride-vinyl acetate-maleic acid terpolymer, polyvinyl butyral, α-olefin-maleic anhydride copolymer, copolymer of ethylene and (meth)acrylic ester, low-molecular-weight styrene resin, ethylene-styrene copolymer, styrene-butadiene copolymer, petroleum resins, rosin resins, terpene resins, polypropylene resins and ionomers. These resins may be used either alone or in combination.

The coating amount of the release layer is preferably from about 0.2 to about 1.0 g/m$^2$.

As the support usable in the present invention, there are polyester films such as polyethylene terephthalate film, polybutylene terephthalate film, polyethylene naphthalate film, polybutylene naphthalate film and polyarylate film, polycarbonate film, polyamide film, aramid film, polyether sulfone film, polysulfone film, polyphenylene sulfide film, polyether ether ketone film, polyether imide film, modified polyphenylene ether film and polyacetal film, and other various plastic films commonly used for the support of recording media of this type. Alternatively, thin paper sheets of high density such as condenser paper can also be used. The thickness of the support is usually from about 1 to about 10 μm. From the standpoint of reducing heat spreading to increase the resolution of printed images, the thickness of the support is preferably from 1 to 6 μm.

A conventionally known heat-resistant protective layer (stick-preventive layer) may be provided on the back side (the side to be brought into slide contact with a thermal head) of the support as required. Examples of materials for the heat-resistant protective layer include various heat-resistant resins such as silicone resins, fluorine-containing resins and nitrocellulose resins, and other resins modified with these heat-resistant resins such as silicone-modified urethane resins and silicone-modified acrylic resins, and mixtures of the foregoing heat-resistant resins and lubricating agents.

A type of the image receptor on which printed images are preferably formed using the aforesaid heat-sensitive transfer recording medium comprises a polyester film. Examples of the polyester film are polyethylene terephthalate film, polybutylene terephthalate film, polyethylene naphthalate film and polyarylate film.

Another type of the image receptor comprises a substrate having thereon an image-receiving layer composed of a polyester resin. Examples of the substrate include polyester films such as polyethylene terephthalate film, polybutylene terephthalate film, polyethylene naphthalate film, polybutylene naphthalate film and polyarylate film, polycarbonate film, polyamide film, aramid film, polyether sulfone film, polysulfone film, polyphenylene sulfide film, polyether ether ketone film, polyether imide film, modified polyphenylene ether film and polyacetal film, and other various plastic films and paper sheets commonly used for the substrate of image receptors of this type. Polyester resins useful in the image-receiving layer are preferably linear saturated polyester resins prepared by polycondensation of one or more acid components and one or more diol components. Examples of the acid components are saturated dicarboxylic acids such as phthalic acid, phthalic anhyddimer aciacic acid and azelaic acid, and dimer acids. Examples of the diol components are ethylene glycol, propylene glycol, decanediol, dedecanediol, hexadecanediol, bisphenol compounds and addition products of bisphenol compounds with ethylene oxide and/or propylene oxide.

The present invention will be more fully described by way of Examples and Comparative Examples. It is to be understood that the present invention is not limited to these Examples, and various changes and modifications may be made in the invention without departing from the spirit and scope thereof.

Preparation of coating liquids for ink layers

Coating liquids for ink layers of the formulations shown in Table 1 were prepared. Specifically the resin component was dissolved into the solvent and the coloring agent was then added to the solution. The resulting mixture was subjected to a dispersing treatment with an attritor for one hour to give ink Nos. 1 to 9.

TABLE 1

| Ink No. | 1 | 2 | 3 | 4 | 5 | 6 | 7 | 8 | 9 |
|---|---|---|---|---|---|---|---|---|---|
| Resin components (parts by weight) | | | | | | | | | |
| Epoxy resin*1 | 2 | 5 | 8 | | | | 2.5 | | |
| Polyester resin A*2 | | | | 3 | 5 | 8 | 2.5 | | |
| Polyester resin B*3 | | | | | | | | 5 | |
| Polyester resin C*4 | | | | | | | | | 5 |
| Coloring agent (parts by weight) | | | | | | | | | |
| Carbon black | 8 | 5 | 2 | 7 | 5 | 2 | 5 | 5 | 5 |
| Organic solvent (parts by weight) | | | | | | | | | |
| Methyl ethyl ketone | 90 | 90 | 90 | 9 | 9 | 9 | 9 | 9 | 9 |
| Ethyl acetate | | | | 63 | 63 | 63 | 63 | 63 | 63 |
| Methyl isobutyl ketone | | | | 18 | 18 | 18 | 18 | 18 | 18 |

*1Epikote 4007P (BPFDGE made by Yuka Shell Epoxy Kabushiki Kaisha, softening point: 109° C.)
*2Vylon 200 (made by TOYOBO CO., LTD., hydroxyl value: 2, glass transition point: 67° C.)
*3Elitel UE3380 (made by UNITIKA Ltd., hydroxyl value: 15, glass transition point: 60° C.)
*4Elitel UE3210 (made by UNITIKA Ltd., hydroxyl value: 5, glass transition point: 45° C.)

Preparation of coating liquid for release layer

A coating liquid for a release layer of the below-mentioned formulation was prepared. Specifically, the polyethylene wax and ethylene-vinyl acetate copolymer were dissolved into toluene heated up to 80° C. and isopropyl alcohol was then added to the solution to precipitate the resin and wax. The resulting mixture was subjected to a dispersing treatment with an attritor for one hour.

| Ingredient | Parts by weight |
|---|---|
| Polyethylene wax (Hiwax 110P made by Mitsui Petrochemical Industries, Ltd.) | 3 |
| Ethylene-vinyl acetate copolymer (Evaflex #410 made by Du Pont-Mitsui Polychemicals Company, Ltd.) | 3 |
| Toluene | 65.8 |
| Isopropyl alcohol | 28.2 |

Fabrication of heat-sensitive transfer recording media

A 4.5 μm-thick polyethylene terephthalate film was formed on one side thereof with a heat-resistant protective layer composed of a silicone resin with a coating amount of 0.4 g/m$^2$. Onto the opposite side of the polyethylene terephthalate film with respect to the protective layer was applied the aforesaid coating liquid for the release layer, followed by drying to form a release layer with a coating amount of 0.4 g/m$^2$.

Onto the release layer were applied two inks selected from the aforesaid ink Nos. 1 to 9 in combination shown in Table 2, followed by drying to form a first ink layer (disposed on the release layer) and a second ink layer (disposed on the first ink layer). Thus, heat-sensitive transfer recording media of Examples 1 to 5 and Comparative Examples 1 to 4 were fabricated.

Evaluation tests

Using each of the thus obtained heat-sensitive transfer recording media, printing was performed under the following conditions with a label printer.

Printing conditions

Printer: TEPRA PRO SR 707 made by King Jim Co., Ltd.

Printing pattern: Test pattern

Printing energy: "Normal" in terms of an indication prescribed in the printer

Receptor: A 54 μm-thick, 18 mm-wide polyethylene terephthalate film tape having an image-receiving layer composed of a polyester resin, loaded in a receptor cassette for the aforesaid printer only.

With respect to the printed matters thus obtained, the following tests for evaluating fastness were performed. The results are shown in Table 2.

Scratch resistance

The printed matter was adhered to the pan of a digital balance and a plastic eraser (Tombow Mono PE-01A made by Tombow Pencil Co., Ltd.) was held vertically on the printed surface and reciprocated 50 times under a load of 2 kg (indication value of the balance) applied by the hand. The condition of the thus treated printed images was evaluated according to the following criteria:

A: the printed image is not changed at all.

B: the printed image is removed a little.

C: the printed image is considerably removed.

D: the printed image disappears.

Alcohol resistance

The printed matter was adhered to the pan of the digital balance and a swab (cotton stick, made by Johnson & Johnson Corp.) soaked with ethanol was held vertically on the printed surface and reciprocated 100 times under a load of 0.5 kg (indication value of the balance) applied by the hand. The condition of the thus treated printed images was evaluated according to the same criteria as in the scratch resistance test.

TABLE 2

| | Examples | | | | | Comparative Examples | | | |
|---|---|---|---|---|---|---|---|---|---|
| | 1 | 2 | 3 | 4 | 5 | 1 | 2 | 3 | 4 |
| 1st ink layer | | | | | | | | | |
| Ink No. | 1 | 2 | 3 | 2 | 2 | 2 | 5 | 7 | 5 |
| Coating amount (g/m$^2$) | 1.0 | 1.0 | 1.0 | 1.0 | 1.0 | 2.0 | 2.0 | 2.0 | 1.0 |
| 2nd ink layer | | | | | | | | | |
| Ink No. | 6 | 5 | 4 | 8 | 9 | — | — | — | 2 |
| Coating amount (g/m$^2$) | 1.0 | 1.0 | 1.0 | 1.0 | 1.0 | — | — | — | 1.0 |
| Evaluation | | | | | | | | | |
| Scratch resistance | A | A | A | B | B | A | C | A | A |
| Alcohol resistance | A | A | A | B | B | D | A | D | D |

As seen from the foregoing, when the heat-sensitive transfer recording medium of the present invention is used to print on an image receptor comprising a polyester film or an image receptor having an image-receiving layer comprising a polyester resin, printed images exhibiting excellent scratch resistance and alcohol resistance are obtained.

In addition to the materials and ingredients used in the Examples, other materials and ingredients can be used in the present invention as set forth in the specification to obtain substantially the same results.

What is claimed is:

1. A heat-sensitive transfer recording medium for use in forming a printed image on an image receptor by a thermal transfer method, comprising a support having thereon a first ink layer and a second ink layer provided on the first ink layer, the first ink layer consisting essentially of a coloring agent and an epoxy resin, the second ink layer comprising a coloring agent and a polyester resin, the first ink layer separating from the support upon the application of heat.

2. The heat-sensitive transfer recording medium of claim 1, wherein the polyester resin of the second ink layer has a hydroxyl value of not greater than 10 and a glass transition point of not lower than 60° C.

3. The heat-sensitive transfer recording medium of claim 1, wherein the epoxy resin of the first ink layer comprises at least one epoxy resin selected from the group consisting of tetraphenolethane tetraglycidyl ether, cresol novolak polyglycidyl ether, bisphenol A diglycidyl ether and bisphenol F diglycidyl ether.

4. A method for forming a printed image on an image receptor comprising the steps of:

providing a heat-sensitive transfer recording medium comprising a support having thereon a first ink layer and a second ink layer provided on the first ink layer, the first ink layer consisting essentially of a coloring agent and an epoxy resin, the second ink layer comprising a coloring agent and a polyester resin, the first ink layer separating from the support upon the application of heat, and selectively heat-transferring the first ink layer and the second ink layer together to form a printed image on an image receptor.

5. The Method if claim 4, wherein the polyester resin of the second ink layer has a hydroxyl value of not greater than 10 and a glass transition point of not lower than 60° C.

6. The method of claim 4, wherein the epoxy resin of the first ink layer comprises at least one epoxy resin selected from the group consisting of tetraphenolethane tetraglycidyl ether, cresol novolak polyglycidyl ether, bisphenol A diglycidyl ether and bisphenol F diglycidyl ether.

7. The method of claim 4, wherein the image receptor comprises a polyester film or a substrate having thereon an image-receiving layer comprising a polyester resin.

* * * * *

UNITED STATES PATENT AND TRADEMARK OFFICE

CERTIFICATE OF CORRECTION

PATENT NO. : 5,888,632

DATED : March 30, 1999

INVENTOR(S) : Yamanaka et al

It is certified that error appears in the above-identified patent and that said Letters Patent is hereby corrected as shown below:

Column 2, line 67 delete "is".

Column 5, line 18 delete "effect" and substitute therefor -- effects --.

Column 8, line 48 delete "anhyddimer aciacic" and substitute therefor -- anhydride, sebacic --.

Column 12, line 7 delete "Method" and substitute therefor -- method --. Delete "if" and substitute therefor -- of --.

Signed and Sealed this

Third Day of October, 2000

*Attest:*

*Attesting Officer*

Q. TODD DICKINSON

*Director of Patents and Trademarks*